United States Patent [19]

Toda et al.

[11] 4,181,527

[45] Jan. 1, 1980

[54] PHOTOGRAPHIC MATERIAL COMPRISING ORGANIC SOLVENT GELLING AGENT

[75] Inventors: Yuzo Toda; Yasuo Mukunoki; Junji Koizumi, all of Ashigara, Japan

[73] Assignee: Fuji Photo Film Co., Ltd., Minami-ashigara, Japan

[21] Appl. No.: 888,446

[22] Filed: Mar. 20, 1978

[30] Foreign Application Priority Data

Mar. 31, 1977 [JP] Japan ..... 52-36294

[51] Int. Cl.[2] ..... G03C 1/40; G03C 1/48; G03C 1/10; G03C 1/84

[52] U.S. Cl. ..... 430/543; 430/222; 430/957; 430/958; 430/635; 430/551; 430/559

[58] Field of Search ..... 96/94 R, 95, 97, 99, 96/100, 111, 112, 114.4, 114.5, 76 R, 77, 84 R, 840 V, 67

[56] References Cited

U.S. PATENT DOCUMENTS

| | | | |
|---|---|---|---|
| 2,322,027 | 1/1943 | Jelley et al. | 96/97 |
| 3,929,485 | 12/1975 | Miyakawa et al. | 96/97 |

*Primary Examiner*—Richard L. Schilling

*Attorney, Agent, or Firm*—Sughrue, Rothwell, Mion, Zinn and Macpeak

[57] ABSTRACT

A photographic light-sensitive material comprising a support having thereon at least one silver halide photographic emulsion layer and containing an emulsified dispersion comprising an organic solvent and an organic solvent gelling agent in at least one hydrophilic colloid layer thereof, a process for producing an emulsified dispersion using an organic solvent gelling agent and a process for stabilizing a photographic light-sensitive material containing an emulsion of an oleophilic photographic additive in a hydrophilic colloid layer thereof using an organic solvent gelling agent.

9 Claims, No Drawings

PHOTOGRAPHIC MATERIAL COMPRISING ORGANIC SOLVENT GELLING AGENT

BACKGROUND OF THE INVENTION

1. Field of the Invention

This invention relates to photographic light-sensitive materials containing an organic solvent gelling agent.

2. Description of the Prior Art

Various methods are known in the art to incorporate a photographic additive, which is insoluble or sparingly soluble in water, into a photographic hydrophilic colloid. Examples of such methods include a method in which the additive is dissolved in a water-miscible organic solvent of high volatility such as, for example, methanol, ethanol, propanol, acetone, dimethylformamide, etc. (hereinafter "high-volatile organic solvent"), and the resultant solution is added to a hydrophilic colloid of which an aqueous gelatin solution is representative; a method in which the additive is solubilized in an aqueous surfactant solution; a method comprising dissolving the additive in an organic solvent, emulsifying the solution using a surfactant and adding the resulting emulsified dispersion to the photographic hydrophilic colloid; etc.

It is also well known to incorporate dispersions of oily substances such as fats, oils (e.g., cetyl palmitate) and liquid paraffin into the protective coating of a photographic light-sensitive material to enhance the surface lubrication properties.

Further, an organic solvent with a low volatility is added in the form of an emulsified dispersion to a hydrophilic colloid layer in order to improve the physical properties of the photographic film structure including the flexibility of the coating.

The present invention relates to photographic materials in which their manufacture includes the procedure of emulsifying and dispersing.

A number of problems which need to be solved in terms of the properties of or performances of the dispersed particles in the above-described dispersions exist. These problems include the tendency of the dispersed particle to grow into coarse particles during manufacture whereby the uniformity of the coated layer is degraded, a deterioration in the physical properties of the coated layers reflected by a softening of the layers to too high an extent, poor anti-blocking characteristics, or poor scratch resistance due to the use of an organic solvent having a low volatility (hereinafter "low-volatile organic solvent") in a high concentration. Further, because of the coarseness of the dispersion particles the coated film has insufficient optical transparency, which in turn tends to cause a deterioration in the image sharpness due to an increase in the light scattering within the coating. Where a solution of a photographic additive such as a coupler in an organic solvent is emulsified, the additive tends to separate out during the manufacture of the photographic material.

SUMMARY OF THE INVENTION

An object of the present invention is, accordingly, to provide photographic materials containing emulsified dispersions with an improved dispersion stability.

Another object of the present invention is to provide photographic light-sensitive materials containing emulsified dispersions of extremely fine particles.

Still another object of the present invention is to provide photographic light-sensitive materials produced using manufacturing procedures including an improved procedure in preparing an emulsified dispersion.

Another object of the present invention is to provide photographic light-sensitive materials having improved film properties.

A further object of the present invention is to provide photographic light-sensitive materials capable of recording images with improved sharpness.

An even further object of this invention is to provide a process for producing a stable emulsified dispersion of extremely fine particles.

Also an object of this invention is to provide a process for stabilizing an emulsified dispersion.

These objects are achieved by incorporating an organic solvent gelling agent into the emulsified dispersion. More specifically, the present invention is achieved by adding an organic solvent gelling agent into the continuous phase of a photographic emulsified dispersion (for example, a gelatin aqueous solution) or the discontinuous (i.e., dispersed) phase of a photographic emulsified dispersion (for example, in each of a low-volatile organic solvent, a high-volatile organic solvent or a mixture thereof and the organic solvent may contain a photographic oleophilic additive therein). In the present invention, it is not essential, although preferred, for the photographic oleophilic additive to be present. Further, when dispersing this liquid, a surface active agent is preferably also employed.

Accordingly, in one embodiment of this invention, this invention provides a photographic light-sensitive material comprising a support having thereon at least one silver halide photographic emulsion layer and containing an emulsified dispersion comprising an organic solvent and an organic solvent gelling agent in at least one hydrophilic colloid layer thereof.

In another embodiment of this invention, this invention provides a process for producing an emulsified dispersion comprising emulsifying and dispersing an organic solvent in a hydrophilic colloid in the presence of an organic solvent gelling agent.

In a further embodiment of this invention, this invention provides a process for improving physical properties of a photographic light-sensitive material comprising a support having thereon at least one silver halide photographic emulsion layer with the photographic light-sensitive material containing an organic solvent emulsified and dispersed in at least one hydrophilic colloid layer thereof which comprises incorporating an organic solvent gelling agent into at least one hydrophilic colloid layer thereof.

DETAILED DESCRIPTION OF THE INVENTION

In the present invention which is associated with emulsions of the oil droplet-in-water type, an extremely fine dispersion of particles can be obtained by incorporating an organic solvent gelling agent either in the organic solvent forming the dispersed phase or in the aqueous phase forming the continuous phase. It should be noted that the dispersion prepared according to the present invention exhibits a very high stability. The term "emulsified dispersion" is used herein to describe a dispersion of "droplets" or "particles" of an organic solvent material which was at least initially liquid during emulsification (but which gels or becomes solid-like ultimately) dispersed in a liquid to distinguish such from a simple dispersion of solid particles which were initially solid during dispersion (which solid particle form does not change) in a liquid. More specifically, in the case of an organic solvent material which was at least initially liquid during emulsification, in the present invention, due to the effect of the organic solvent gelling agent, the organic solvent material gels or becomes solid-like. Since such initially technically is an emulsion of liquid droplets in a liquid and when such gels or becomes solid or solid-like ultimately technically is a dispersion in a liquid, the term "emulsified dispersion" is used to describe this situation. Thus, also in the description to be given herein, the term "particles" is used in a broad sense as covering both solid particles and gelled liquid droplets.

The physical and mechanical properties of the photographic light-sensitive material produced by the use of such an emulsified dispersion are far improved in comparison to those containing conventionally prepared dispersions.

The organic solvent forming the oily phase in the emulsified dispersion of the present invention generally comprises low-volatile organic solvents with a boiling point of about 175° C. or higher and/or high-volatile organic solvents with a boiling point of from about 30° C. to about 150° C. at normal atmospheric pressure. When such a low-volatile solvent and such a high-volatile solvent is mixed, the mixing ratio can be varied arbitrarily.

Suitable low-volatile organic solvents include those set forth in the following patents: U.S. Pat. No. 2,322,027, U.S. Pat. No. 2,533,514, U.S. Pat. No. 2,835,579, Japanese Patent Publication No. 23,233/1971, U.S. Pat. No. 3,287,137, British Pat. No. 958,441, Japanese Patent Application (OPI) No. 1,031/1972 (the term "OPI" as used herein refers to a "published unexamined Japanese patent application," hereinafter the same), British Pat. No. 1,222,753, U.S. Pat. No. 3,936,303, Japanese Patent Application (OPI) No. 26,037/1976, Japanese Patent Application (OPI) No. 82,078/1975, U.S. Pat. No. 2,353,262, U.S. Pat. No. 2,852,383, U.S. Pat. No. 3,554, 755, U.S. Pat. No. 3,676,137, U.S. Pat. No. 3,676,142, U.S. Pat. No. 3,700,454, U.S. Pat. No. 3,748,141, U.S. Pat. No. 3,837,863, German Patent Application (OLS) No. 2,538,889, Japanese Patent Application (OPI) No. 27,921/1976, Japanese Patent Applications (OPI) Nos. 27,922/1976, 26,035/1976, 26,036/1976 and 62,632/1976, Japanese Patent Publication No. 29,461/1974, U.S. Pat. No. 3,936,303, U.S. Pat. No. 2,256,658, etc. More specifically, the following organic solvents can be used in the present invention: esters (e.g., phthalates, phosphates, citrates, benzoates, fatty acid esters, carbonates, etc.), amides (e.g., fatty acid amides, sulfonamides, etc.), ethers (e.g., allyl ethers, etc.), alcohols, paraffins, etc. Particularly preferred organic solvents include phthalic acid esters such as dibutyl phthalate, dihexyl phthalate, diheptyl phthalate, dioctyl phthalate, dinonyl phthalate, didecyl phthalate, butylphthalyl butyl glycolate, dibutyl monochlorophthalate, etc.; phosphoric acid esters such as triscresyl phosphate, trixylenyl phosphate, tris(isopropylphenyl)-phosphate, tributyl phosphate, trihexyl phosphate, trioctyl phosphate, trinonyl phosphate, tridecyl phosphate, trioleyl phosphate, tris(butoxyethyl)phosphate, tris(chloroethyl)phosphate, tris(dichloropropyl)phosphate, etc.; citric acid esters such as, for example, O-acetyltriethyl (alternatively, butyl, hexyl, octyl, nonyl, and decyl) citrate, triethyl (alternatively, butyl, hexyl, octyl, nonyl, decyl, or tridecyl in place of ethyl-) citrate, etc.; benzoic acid esters such as butyl, hexyl, heptyl, octyl, nonyl, decyl, dodecyl, tridecyl, tetradecyl, hexadecyl, octadecyl, or oleyl benzoate, pentyl o-methylbenzoate, docyl p-methylbenzoate, octyl o-chlorobenzoate, lauryl p-chlorobenzoate, propyl 2,4-dichlorobenzoate, octyl 2,4-dichlorobenzoate, stearyl 2,4-dichlorobenzoate, octyl p-methoxybenzoate, etc.; fatty acid esters such as, for example, hexadecyl myristate, dibutoxyethyl succinate, dioctyl adipate, dioctyl azelate, decamethylene-1,10-diol diacetate, triacetin, tributin, benzyl caprate, pentaerythritol tetracaproate, isosorbide caprilate, etc.; amides such as, for example, N,N-dimethyllauramide, N,N-dimethylcaprylamide, N-butylbenzene sulfonamide, etc.; trioctyl trimellitate; chlorinated paraffins; etc.

High-volatile organic solvents suitable for use in the present invention include, for example, lower alkyl acetates such as ethyl and butyl acetate, ethyl propionate, sec-butyl alcohol, methyl isobutyl ketone, $\beta$-ethoxyethyl acetate, methyl Cellosolve acetate, etc. The low-volatile organic solvents cited earlier and the high-volatile organic solvents can be mixed in various ratios depending on the requirement involved.

Examples of organic solvent gelling agents used in the present invention include, for example, N-acylamino acid esters, N-acylamino acid amides, or N-acylamino acid amine salts disclosed in Japanese Patent Publication No. 48,467/1976, dehydrated condensates between benzaldehyde and xylitol or derivatives thereof disclosed in Japanese Patent Publication No. 47,665/1976, the dehydrated condensates between benzaldehyde or nucleus-substituted benzaldehydes and sorbitol or xylitol, etc. Thus, the organic solvent gelling agent used in the present invention can be classified as:

(1) $\alpha$-, $\beta$-, $\omega$-neutral, acidic or basic amino acids of which the amino group is acylated and of which the carboxyl group is esterified, amidated or in the form of a salt; and (2) dehydrated condensates of benzaldehyde with xylitol or sorbitol.

Examples of suitable neutral amino acids which can be employed are glycine, $\beta$-alanine, valine (i.e., $\alpha$-aminoisovaleric acid), serine (i.e., $\alpha$-aminohydracrylic acid), phenylalanine, 3,4-dioxyphenylalanine, cysteine, methionine and $\omega$-aminocaproic acid. Examples of suitable acidic amino acids which can be employed are glutamic acid and aspartic acid and examples of suitable basic amino acids which can be employed are lysine, ornithine and arginine.

While not desiring to be bound, it is thought the organic solvent gelling agent used in the present invention effectively makes the oily phase in the emulsified dispersion solid or highly viscous, thus enhancing the fine dispersion of the emulsified particles. Therefore, any type of organic solvent gelling agent can be used for the present invention as long as it exerts the effect described above, and the present invention is not limited to the compounds illustrated above. Two or more different organic solvent gelling agents can be used together in an arbitrary mixing ratio, if desired.

Examples of photographic additives which are insoluble or sparingly soluble in water (oleophilic) and which can be dispersed according to the present invention include, for example, oil soluble or protected couplers, antioxidants and anti-fading agents both of which prevent color mixing or color fading (e.g., alkylhydroquinones, alkylphenols, cumarones, chromans, etc.), hardening agents, oil soluble filter dyes, oil soluble UV absorbing agents, DIR compounds (e.g., DIR hydroquinones, colorless DIR compounds, etc.), developing agents, dye developers, DRR compounds, DDR couplers, etc. These additives are given merely for the purposes of illustration and are not to be construed as limiting.

More specifically, photographic couplers which can be used in the present invention include compounds capable of forming a color by an oxidation coupling reaction with an aromatic primary amine developing agent (for example, phenylenediamine derivatives, aminophenol derivatives, etc.) in a color developing process. Examples of magenta couplers include 5-pyrazolone couplers, pyrazolobenzimidazole couplers, cyanoacetylcumarone couplers, open chain acylacetonitrile couplers, etc. Examples of yellow couplers include acylacetoamide couplers (such as benzoylacetoanilides, pivaloylacetoanilides, etc.), etc. Examples of cyan couplers include naphthol couplers, phenol couplers, etc.

Suitable specific magenta couplers which can be used in the present invention are described in U.S. Pat. Nos. 2,600,788, 3,558,319, 3,935,015, 3,933,500, 3,926,631, 3,061,432, 4,012,259, 3,476,560, 3,227,550, 3,252,924, 3,311,476 and 3,419,391, British Pat. No. 1,293,640, West German Patent Application (OLS) Nos. 2,015,867, 2,418,959, 2,414,832, 2,424,467, 2,510,538 and 2,526,112, and Japanese Patent Applications (OPI) Nos. 110,665/1974 and 117,464/1974.

Couplers capable of releasing a development inhibitor (i.e., DIR coupler) can be employed in the invention and suitable examples are described in U.S. Pat. Nos. 3,148,062, 3,227,554, 3,615,506 and 3,701,783.

Suitable specific yellow couplers which can be used in the present invention are described in U.S. Pat. Nos. 3,227,550, 3,253,924, 3,277,155, 3,265,56, 3,408,194 and 3,415,652, French Pat. No. 1,411,384, British Pat. Nos. 944,490, 1,040,710 and 1,118,028 and West German Patent Application (OLS) Nos. 2,057,941, 2,163,812, 2,213,461 and 2,219,971.

DIR yellow couplers which can be used in the present invention are described in U.S. Pat. Nos. 3,148,062, 3,227,554 and 3,617,291.

Cyan couplers which can be used in the present invention are described in U.S. Pat. Nos. 2,423,730, 3,227,550 and 3,311,476, British Pat. Nos. 1,084,480 and 1,165,563, U.S. Pat. Nos. 2,983,608, 3,005,712 and 3,034,892, British Pat. Nos. 936,621, 1,269,073, 586,211 and 627,814 and French Pat. No. 980,372, 1,091,930, 1,257,887, 1,398,308 and 2,015,649.

DIR cyan couplers which can be used in the present invention are described in British Pat. No. 1,201,110 and U.S. Pat. Nos. 3,148,062, 3,227,554, 3,617,291 and 3,622,328.

Colorless DIR coupling compounds which can be used in the present invention are described in U.S. Pat. Nos. 3,632,345 and 3,379,529, West German Patent Applications (OLS) Nos. 2,610,546, 2,610,548 and 2,527,652 and Japanese Patent Application (OPI) No. 72,433/1976.

Additives for diffusion transfer photographic materials which can be used in the present invention are diffusible dye releasing type redox compounds (i.e., DRR compounds), diffusible dye releasing type couplers (i.e., DDR couplers), color developing agents and amidrazone compounds capable of releasing a diffusible dye by reacting with an oxidation product of a developing agent.

Specific suitable diffusible dye releasing type redox compounds (i.e., DRR compounds) are described in Japanese Patent Applications (open to public inspection) 33,826/1973, 126,331/1974, 126,332/1974 and 114,930/1976 and West German Patent Application (OLS) No. 2,613,005.

Diffusible dye releasing type couplers (i.e., DDR couplers) capable of releasing a diffusible dye by reacting with a color developing agent can be used in the present invention and are described in British Pat. Nos. 840,731, 904,364 and 1,038,331, U.S. Pat. Nos. 2,756,142, 3,227,550, 3,227,551, 3,227,554 and 3,765,886, U.S. Defensive Publication No. T-900,029, Japanese Patent Applications (OPI) Nos. 123,022/1974 and 133,021/1976 and West German Patent Application (OLS) No. 2,630,999.

Amidrazone compounds capable of releasing a diffusible dye by reacting with an oxidation product of a developing agent can be used in the present invention and are described in Japanese Patent Publication No. 39,165/1973, Japanese Patent Applications (OPI) Nos. 2,327/1972 and 64,436/1974.

Suitable color developing agents which can be used in the present invention are described in U.S. Pat. Nos. 3,953,211, 3,793,028, 3,999,991, 4,014,700, 2,983,606, 3,551,406, 3,563,739, 3,597,200, 3,674,478, 3,320,063, 3,230,082, 3,307,947, 3,579,334, 3,299,041, 2,983,605, 3,994,731, 2,992,106, 3,047,386, 3,076,808, 3,076,820, 3,077,402, 3,126,280, 3,131,061, 3,134,762, 3,134,765, 3,135,604, 3,136,605, 3,135,606, 3,135,734, 3,141,772, 3,142,565, 3,173,906, 3,183,090, 3,246,985, 3,230,086, 3,309,199, 3,230,083, 3,239,339, 3,347,672, 3,347,673, 3,245,790 and 3,230,082, West German Patent Application (OLS) No. 2,458,212 and Japanese Patent Applications (OPI) Nos. 42,536/1976, 117,456/1974 and 161,525/1975.

Suitable antioxidants which can be used in the present invention include phenols substituted with an aliphatic group having 8 or more carbon atoms, hydroquinone derivatives or precursors thereof. Examples of antioxidants which can be used in the present invention are described in U.S. Pat. Nos. 2,336,327, 2,728,659 and 2,835,579 and Japanese Patent Application (OPI) No. 2,128/1971.

Antioxidants for color images which are described in West German Pat. No. 1,547,684, West German Patent Application (OLS) No. 2,146,668 and Belgian Pat. No. 777,487 are preferred for use.

Filter dyes which can be used in the present invention include oleophilic oxonol dyes, benzotriazole type ultraviolet light absorbing agents and benzophenone type ultraviolet light absorbing agents. Examples of filter dyes which can be used in the present invention are described in Japanese Patent Publications Nos. 21,687/1967 and 5,496/1973, Japanese Patent Applications (OPI) Nos. 1,026/1972 and 2,784/1971 and British Pat. No. 1,293,982.

A photographic additive, e.g., as described above, is dissolved in a suitable organic solvent of low or high volatility, or in a mixture of low-volatile and high-volatile organic solvents, and the resulting solution is dispersed in an aqueous phase with the aid of a surfactant whereby the aqueous phase can contain a hydrophilic organic colloid such as, for example, gelatin. The emulsified dispersion thus-prepared is added to any hydrophilic organic colloid layer of the photographic light-sensitive material such as, for example, a light-sensitive silver halide emulsion layer, a filter layer, intermediate layers, a back coating, an antihalation layer, a protective coating, etc.

Suitable methods of preparing the emulsified dispersion used in the present invention include the method disclosed in U.S. Pat. No. 2,332,027 in which "Gardinol WA" (trade name for a sulfonated coconut fatty alcohol, commercially available from E. I. du Pont de Nemours Co., Inc.) is used together with triisopropylnaphthalene sulfonate, the method set forth in Japanese Patent Publication No. 8,191/1967 in which a water-soluble coupler having a sulfonyl or a carboxyl group as well as a long-chain aliphatic group is used, a method which employs a sulfonyl group-containing anionic surface active agent in combination with an anhydrohexyl ester type nonionic surface active agent, etc.

Of the n-acylamino acid derivatives which can be used as an organic solvent gelling agent in the present invention, the N-acylamino acid esters and the N-acylamino acid amides may be obtained by, for example, reacting an N-acylamino acid with an alcohol or with an amine in the presence of an acid catalyst or in the absence of a catalyst at an elevated temperature, or by acylating an amino acid ester or an amino acid amide with an acylating agent such as a fatty acid halide. N-Acylamino acid amine salts can be prepared by neutralization of an N-acylamino acid with an amine. Alternatively, a gelled organic solvent system can be obtained by introducing an N-acylamino acid or a metal salt thereof together with an amine or the acid adduct thereof in the form of a powder or a solution into a water-containing organic solvent system.

Suitable amino acids which can be used as starting materials include $\alpha$-, $\beta$-, and $\omega$-amino acids; particularly, glycine, $\alpha$- and $\beta$-alanine, valine, serine, phenylalanine, 3,4-dioxyphenylalanine, cysteine, methionine, $\epsilon$-aminocaproic acid, lysine, ornithine, arginine, glutamic acid, aspartic acid, etc. Mixtures of different amino acids can be used, if desired. For example, hydrolyzed products of proteins from various sources such as soybean, fish, or algal fungi are therefore applicable as well as the waste residues resulting from amino acid synthesis.

Suitable N-acyl groups involved in the N-acylamino acid derivatives which can be used in the present invention include acyl groups containing a straight or branched chain aliphatic moiety having 1 to 30 carbon atoms which may be saturated or unsaturated, and acyl groups containing an aryl moiety. Particularly suitable acyl groups are acetyl, propionyl, butanoyl, pentanoyl, caproyl, capryloyl, lauroyl, myristoyl and stearoyl groups, which can be used individually or in combination.

Alcohols used for esterification include aliphatic alcohols having 1 to 30 carbon atoms which may be straight or branched chain, saturated or unsaturated. Particularly suitable alcohols are methyl, ethyl, propyl, butyl, hexyl, octyl, lauryl, cetyl, and stearyl alcohols. Further, alicyclic alcohols such as cyclohexanol and aromatic alcohols such as benzyl alcohol can also be used.

Amines which can be used for the conversion of an acid to the amide or to the amine salt include ammonia, straight or branched chain, saturated or unsaturated, primary and secondary amines containing 1 to 60 carbon atoms, mono- or dialcoholamines (e.g., mono- and diethanolamine, etc.), and, further, for the preparation of amine salts, tertiary amines and trialcoholamines (e.g., triethanolamine, etc.) can be employed. In particular, butylamine, octylamine, laurylamine, isostearylamine, stearylamine, etc., are preferred. In addition to these aliphatic amines, alicyclic amines such as cyclohexylamine and aromatic amines such as benzylamine can also be used.

Methods of preparing amino-acid derivatives are described in Greenstein and Wintz, *Chemistry of the Amino Acid,* Vol. 2, John Wiley & Sons, Inc. (1961).

The N-acylamino acid derivatives used in the present invention can be prepared by the methods described in the following references or can be prepared by employing methods similar to those described in the following references: I. Levi et al., *J. Med. Chem.*, 8, 715 (1965), L. Benoiton, *Can. J. Chem. Soc.*, 41, 1718 (1963), M. Bergmann et al., *J. Biol. Chem.*, 127, 643 (1939), R. W. Chambers et al., *J. Am. Chem. Soc.*, 77, 1522 (1955), M. Takehara et al., *J. Am. Oil Chem.*, 49, 157 (1972), A. Nagamatsu et al., *Chem. Pharm. Bull.*, 16, 211 (1968), and E. Jungermann et al., *J. Am. Chem. Soc.*, 78, 172 (1956).

The degree of gelling capability depends on the well-balanced combination of the N-acyl group and the organic group involved in the ester, the amide or in the amine salt moiety. Generally speaking, an excellent performance results when one or both of the two moieties comprises a higher alkyl group containing 8 or more carbon atoms.

Another group of organic solvent gelling agents which can be used in the present invention comprises monobenzylidenesorbitol, dibenzylidenesorbitol (e.g., "Gel-ol D", trade name, available from Shin-Nippon Rika Co.), tribenzylidenesorbitol, mono- and dibenzylidenexylitol, dehydrated condensation products of benzaldehydes nucleus-substituted with methyl, isopropyl, oxy, chloro, methoxy, ethoxy, amino, nitro groups, etc., and sorbitol or xylitol. These compounds may be used in a pure form or in combination with each other. Such a dehydrated condensation product can be prepared by condensing a benzaldehyde derivative with sorbitol or xylitol in the presence of an acid catalyst.

A typical synthesis examples for the preparation of the condensation products described above useful as the organic solvent gelling agent of the present invention is described below.

SYNTHESIS EXAMPLE

Synthesis of Benzylidenexylitol

90 Parts by weight of xylitol (75 wt% aqueous solution), 42 parts by weight of benzaldehyde, 60 parts by weight of methanol, 6 parts by weight of conc. $H_2SO_4$ and 6 parts by weight of water were reacted with refluxing for two hours. After cooling, the solidified product was ground and washed with water and, then, neutralized with 10 wt% sodium hydroxide aqueous solution followed by washing with water and drying to obtain benzylidenexylitol.

One preferred embodiment of the present invention comprises preparing a solution containing a photographic additive such as a coupler and an organic solvent gelling agent dissolved in a solvent comprising a low-volatile organic solvent having a boiling point of about 175° C. or higher (e.g., dibutyl phthalate), in a high-volatile organic solvent with a boiling point between about 30° C. and about 150° C. (e.g., ethyl acetate), or in a mixture of these two, mixing the solution with another solution containing a surfactant and a hydrophilic colloid such as gelatin, emulsifying the mixture using a high-speed mixer or a colloid mill, and adding the resultant dispersion into a photographic coating mixture containing a hydrophilic colloid. Alternatively, the emulsified dispersion described above is subjected to a reduced pressure so as to remove the low boiling point organic solvent, or is cooled and set as a solid, which is cut into pieces and washed with water to remove the low boiling point organic solvent. After such a solvent removal operation, the dispersion is added to a photographic coating mixture containing a hydrophilic colloid. By coating the coating mixture thus-prepared onto an appropriate substrate, a photographic light-sensitive material of the present invention can be produced. The emulsified dispersion may not always contain a photographic additive. As was described earlier, the organic solvent gelling agent may be present in the discontinuous oil phase or in the continuous aqueous phase. The discontinuous phase may or may not contain a hydrophilic colloid. It should be noted that the low boiling point organic solvent, for example, ethyl acetate, is not substantially present in the ultimately obtained dried photographic coating, since the low-boiling point organic solvent easily escapes from the coating during the drying process of the photographic material by evaporation.

In another preferred embodiment of the present invention, an organic solvent gelling agent, either an N-acylamino acid derivative or a dehydrated condensate of benzaldehyde with xylitol or sorbitol, is added to a low-volatile organic solvent, if desired, a high-volatile organic solvent can be added thereto. Further, if desired, photographic oleophilic additives are added to the mixture. Then, the mixture is dissolved at a temperature of from about 20° C. to the boiling point of the solution, preferably about 40° C. to about 80° C. and emulsified using a surfactant. The time for the emulsification will vary due to emulsification conditions such as kind of emulsifier, temperature of emulsification, kind of surfactant and amount of surfactant.

The organic solvent gelling agent used in the present invention can be employed in an amount of about 0.001% by weight or higher, more preferably between 0.01 and 20% by weight, relative to the weight of the organic solvent.

While such will vary depending on various factors such as the organic solvent used, organic solvent gelling agent used, oleophilic photographic additive(s) present, etc., in general, a suitable amount of the organic solvent to the hydrophilic material (e.g., gelatin) present in the emulsified dispersion is about 5% to 300% by weight, preferably about 10% to 200% by weight, and a suitable amount of the organic solvent to the water present in the emulsified dispersion is about 0.5% to 30% by weight, preferably about 1% to 20% by weight. The above is merely exemplary and should not be considered limiting.

The temperature at which the organic solvent gelling agent is introduced in the system should preferably be above the gelling temperature thereof when the organic solvent gelling agent is added in the organic solvent prior to dispersion, although in principle no strict limitation is imposed.

Specific examples of organic solvent gelling agents suitable for use in the present invention are listed below.

(I-1) N-Lauroylglutamic acid dibutylamide
(I-2) N-Lauroylglutamic acid distearylamide
(I-3) N-Lauroylvaline laurylamide
(I-4) N-Lauroylglutamic acid dioctylamide
(I-5) N-Lauroylglutamic acid di(monoethanol)amide
(I-6) $N^{\alpha}$,$N^{\epsilon}$-Dicapryloyllysine lauryl ester
(I-7) $N^{\alpha}$,$N^{\epsilon}$-Dicapryloyllysine laurylamide
(I-8) $N^{\alpha}$,$N^{\epsilon}$-Dicapryloyllysine laurylamine salt
(I-9) $N^{\alpha}$,$N^{\epsilon}$-Dicapryloyllysine monoethanolamide
(I-10) N,N-Dilauroyllysine stearylamine
(I-11) N,N-Dicapryloyllysine partial sodium salt
(I-12) N,N-Dicapryloyllysine partial ammonium salt
(I-13) N-Lauroylphenylalanine laurylamide
(I-14) N-Lauroylphenylalanine laurylamine salt
(I-15) N-Lauroylvaline butylamide
(I-16) Dicaproylornithine laurylamide
(I-17) Dicaproylornithine lauryl ester
(II-1) Monobenzylidenesorbitol
(II-2) Dibenzylidenesorbitol
(II-3) Tribenzylidenesorbitol
(II-4) Monobenzylidenexylitol
(II-5) Dibenzylidenexylitol
(II-6) Mono(methylbenzylidene)xylitol
(II-7) Mono(methylbenzylidene)sorbitol
(II-8) Mono(methoxybenzylidene)xylitol
(II-9) Mono(ethoxybenzylidene)xylitol
(II-10) Mono(chlorobenzylidene)xylitol
(II-11) Mono(chlorobenzylidene)sorbitol The emulsified dispersion prepared by the present invention is added to a photographic coating solution containing a hydrophilic colloid which is used for forming a photographic light-sensitive silver halide emulsion layer, an intermediate layer, an antihalation layer, a filter layer and a protective layer of a photographic material. These layers are usually coated in a dry thickness of about 0.2μ to about 10μ, preferably about 0.3μ to about 8μ. In general, the amount of organic solvent present in these layers will be about 80% (vol/vol) or less of total amount of hydrophilic colloid in the layer, preferably 40% (vol/vol) or less.

The high-volatile organic solvent (i.e., low boiling organic solvent) is usually removed by noodle-washing or evaporation after emulsification, or is removed on drying of the photographic material after coating. Therefore, barely little of the high-volatile organic solvent remains in the photographic material finished.

Suitable substrates which can be used for the photographic light-sensitive material of the present invention include, for example, films or laminates of cellulose nitrate, cellulose acetate, cellulose acetate butyrate, cellulose acetate propionate, polystyrene, poly(ethylene terephthalate), polycarbonate, etc., paper and still other materials ordinarily used as photographic supports. Furthermore, baryta-coated paper, paper substrates coated or laminated with an α-olefin polymer such as polyethylene, polypropylene, etc., in which the olefinic monomer contains 2 to 10 carbon atoms, or synthetic resin films having a roughened surface for improvement of adhesion to other polymeric materials are also suitable.

A number of hydrophilic colloids can be used as the binder of the photographic silver halide emulsion layer as well as of other light-insensitive layers in the photographic material of the present invention. Suitable hydrophilic colloid materials include gelatin, colloidal albumin, casein, cellulose derivatives such as carboxymethylcellulose, hydroxyethylcellulose, etc., agar-agar, sodium alginate, starch derivatives and other carbohydrate derivatives, synthetic hydrophilic colloids such as poly(vinyl alcohol), poly(N-vinylpyrrolidone), acrylic acid copolymers, maleic anhydride copolymers, polyacrylamide, derivatives thereof, the partially hydrolyzed products thereof, etc. Compatible combinations of these materials may be used depending on the requirements involved.

The representative example of a hydrophilic colloid is gelatin. Gelatin can be replaced at least partly by other synthetic polymers or gelatin derivatives which are prepared by processing or modifying gelatin with an agent containing at least one functional group reactive with the functional groups present in the gelatin molecule such as amino, imino, hydroxy or carboxyl groups. Graft polymers obtained by grafting a molecular chain of another synthetic polymer to gelatin may also be used.

Suitable agents which are used to prepare the gelatin derivatives described above include isocyanates, acid chlorides, acid anhydrides as set forth in, for example, U.S. Pat. No. 2,614,928, acid anhydrides disclosed in U.S. Pat. No. 3,118,766, bromoacetic acids disclosed in Japanese Patent Publication No. 5,514/1964, phenyl glycidyl ethers as disclosed in Japanese Patent Publication No. 26,845/1967, vinyl sulfone compounds described in U.S. Pat. No. 3,132,945, N-allylvinylsulfonamides described in British Pat. No. 861,414, maleinimides as disclosed in U.S. Pat. No. 3,186,846, acrylonitriles shown in U.S. Pat. No. 2,594,293, poly(alkylene oxides) set forth in U.S. Pat. No. 3,312,553, epoxide compounds as shown in Japanese Patent Publication No. 26,845/1967, esters disclosed in U.S. Pat. No. 2,763,639, alkanesultones disclosed in British Pat. No. 1,033,189, etc. Suitable polymer chains which can be grafted to gelatin are described in U.S. Pat. Nos. 2,763,625, 2,831,767, and 2,956,884, *Polymer Letters*, 5, pp. 595 (1967), *Phot. Sci. Eng.*, 9, pp. 148 (1965), *J. Polymer Sci., A*-1, pp. 3199 (1971), etc., including homo- and copolymers of the so-called vinyl monomers such as acrylic acid, methacrylic acid, acrylic and methacrylic esters, acryl- and methacrylamides, acrylo- and methacrylonitriles, styrene, etc. Particularly suitable monomers are those that are compatible with gelatin to some extent, including acrylic acid, acrylamide, methacrylamide, hydroxyalkyl acrylates, hydroxyalkyl methacrylates, etc.

The photographic emulsion and the other layers in the photographic material of the present invention can also contain synthetic polymeric materials. For example, an aqueous latex of a water-dispersible vinyl polymer can be added alone or in combination with a hydrophilic, water-permeable colloid in order to improve the dimensional stability of the resulting photographic material.

Descriptions of suitable polymeric materials appear, for example, in U.S. Pat. Nos. 2,376,005, 2,739,137, 2,853,457, 3,488,708, 3,525,620, 3,635,715, 3,607,290 and 3,645,740, British Pat. Nos. 1,186,699 and 1,307,373. Suitable compounds are homo- and copolymers comprising alkyl acrylates, alkyl methacrylates, acrylic acid, methacrylic acid, sulfoalkyl acrylates, sulfoalkyl methacrylates, glycidyl acrylates, glycidyl methacrylates, hydroxyalkyl acrylates, hydroxyalkyl methacrylates, alkoxyalkyl acrylates, alkoxyalkyl methacrylates, styrene, butadiene, vinyl chloride, vinylidene chloride, maleic anhydride, and itaconic anhydride. Where such a vinyl monomer is emulsion-polymerized, a hydrophilic, protective colloid may be used to provide a so-called grafted, emulsion-polymerized latex.

The photographic silver halide emulsion layer or other light-insensitive layers forming a photographic multilayer structure can be hardened using conventionally known methods. Suitable hardening agents which can be used include, for example, aldehydes such as formaldehyde and glutaraldehyde, ketones such as diacetyl, cyclopentanedione, etc., compounds containing a reactive halogen atom such as bis(2-chloroethylurea), 2-hydroxy-4,6-dichloro-1,3,5-triazine, compounds set forth in U.S. Pat. Nos. 3,288,775 and 2,732,303, and British Pat. Nos. 974,723 and 1,167,207, compounds having a reactive olefinic group such as divinylsulfone, 5-acetyl-1,3-diacryloylhexahydro-1,3,5-triazine, and compounds disclosed in U.S. Pat. Nos. 3,635,718, 3,232,763 and 3,490,911, British Pat. No. 994,869, etc., N-hydroxymethylphthalimide, N-methylol compounds as disclosed in U.S. Pat. Nos. 2,732,316 and 2,586,168, isocyanate compounds as disclosed in U.S. Pat. No. 3,103,437, etc., aziridine compounds as disclosed in U.S. Pat. Nos. 3,017,280 and 2,983,611, acid derivatives as disclosed in U.S. Pat. Nos. 2,725,294 and 2,725,295, carbodiimide compounds as disclosed in U.S. Pat. No. 3,100,704, epoxy compounds set forth in U.S. Pat. No. 3,091,537, isooxazole compounds as described in U.S. Pat. Nos. 3,321,313 and 3,543,292, halocarboxyaldehydes such as mucochloric acid, dioxane derivatives such as dihydroxydioxane, dichlorodioxane, etc., and inorganic hardening agents such as chromium alum, zirconium sulfate, etc. Instead of these compounds, hardener precursors can be used, including alkali metal bisulfite-aldehyde adducts, methylol derivatives, of hydantoin, primary aliphatic nitro alcohols, etc.

The silver halide photographic emulsion can be conventionally prepared by mixing a water-soluble silver salt (e.g., silver nitrate) with a water-soluble halide (e.g., potassium bromide) in the presence of a water-soluble polymer such as gelatin. Suitable silver halides which can be used include silver chloride, silver bromide and mixed silver halides such as silver chlorobromide, silver iodobromide, silver chloroiodobromide, etc. The grains of the silver halide can be prepared using any known method including the single- and double-jet methods, etc. Two kinds of silver halide emulsions, each prepared by a different method, can be blended for use.

An anti-foggant can be added to the photographic silver halide emulsion in order to prevent a reduction in photographic speed and generation of fog during manufacture, storage or processing. Suitable anti-foggants are 4-hydroxy-6-methyl-1,3,3a,7-tetrazaindene, 3-methylbenzothiazole, 1-phenyl-5-mercaptotetrazole, and various heteronuclear compounds, mercury-containing compounds, mercapto derivatives and metal salts. Useful anti-foggants are described in U.S. Pat. Nos. 1,758,576, 2,110,178, 2,131,038, 2,173,628, 2,697,040, 2,304,962, 2,324,123, 2,394,198, 2,444,605, 2,444,606, 2,444,607, 2,444,608, 2,566,245, 2,694,716, 2,697,099, 2,708,162, 2,728,663 to 2,728,665, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668, 3,619,198, 3,622,339 and 3,650,759, British Pat. Nos. 893,428, 403,789, 1,173,609 and 1,200,188, etc.

As is well known in the art, the silver halide emulsions can be sensitized chemically. Preferred chemical sensitizers include gold compounds (e.g., chloroaurates, gold trichloride, etc.) which are disclosed in, for example, U.S. Pat. Nos. 2,399,083, 2,540,085, 2,597,856 and 2,597,915, noble metal salts containing Pt, Pd, Ir, Rh, Ru, etc., such as disclosed in U.S. Pat. Nos. 2,448,060, 2,540,086, 2,566,245, 2,566,263 and 2,598,079, sulfur compounds capable of reacting with silver salts to form silver sulfide, as disclosed in U.S. Pat. Nos. 1,574,944, 2,410,689, 3,189,458, 3,501,313, etc., and other reducing agents (e.g., stannous salts, organic amines, etc.) as disclosed in U.S. Pat. Nos. 2,487,850, 2,518,698, 2,521,925, 2,521,926, 2,694,637, 2,983,610 and 3,201,254.

The photographic silver halide emulsions used in this invention can be spectrally or supersensitized by use of one or more dyes selected from cyanine (cyanine, merocyanine and carbocyanine), styryl, etc., dyes. Spectral sensitization techniques are described in detail in U.S. Pat. Nos. 2,493,748, 2,519,001, 2,977,229, 3,480,434, 3,672,897, 3,703,377, 2,688,545, 2,912,329, 3,397,060, 3,615,635 and 3,528,964, British Pat. Nos. 1,195,302, 1,242,588 and 1,293,862, German Patent Applications (OLS) Nos. 2,030,326 and 2,121,780, Japanese Patent Publications Nos. 4,936/1968, 14,030/1969 and 10,773/1968, U.S. Pat. Nos. 3,511,664, 3,522,052, 3,527,641, 3,615,613, 3,615,632, 3,617,295, 3,635,721 and 3,694,217, British Pat. Nos. 1,137,580 and 1,216,203, etc. Individual dye sensitizers are selected on the basis of the wavelength region of spectral sensitization, photographic speed, etc., which depend on the purpose as well as the application of the photographic material.

The photographic light-sensitive material of the present invention can include polyols as plasticizer therein. Suitable polyols are described, for example, in U.S. Pat. Nos. 2,960,404, 3,042,524, 3,520,694, 3,656,956, and 3,640,721.

The photographic light-sensitive material of the present invention can contain various light-insensitive auxiliary layers such as, for example, a protective coating, a filter layer, intermediate layers, an antihalation layer, a subbing layer, an antistatic layer and a curl eliminating layer in addition to the silver halide photographic emulsion layers.

Suitable additives which can be incorporated in the light-insensitive auxiliary layers include brightening agents such as, for example, stilbene, triazine, oxazole and coumarin derivatives, UV absorbing agents such as, for example, benzotriazole, thiazolidine and cinnamate derivatives, light absorbing agents such as those known as photographic filter dyes, the water-insoluble materials disclosed in, for example, British Pat. Nos. 1,320,564 and 1,320,565, and U.S. Pat. No. 3,121,060, and the surfactants disclosed in U.S. Pat. No. 3,617,286. Further, a surface matting agent may also be present and examples include silver halide grains with an appropriate particle size, silica, (Sr, Ba)$SO_4$, and other inorganic compounds, finely divided polymer particles such as poly(methyl methacrylate), etc.

Any layer of the photographic light-sensitive material of the present invention, including the photographic silver halide emulsion layer and, in particular, the antistatic layer which is often provided as one of the outermost coating layers of a photographic material, can contain an antistatic agent. Suitable antistatic agents which can be used include hydrophilic polymeric materials, for example, as described in U.S. Pat. Nos. 2,725,297, 2,972,535, 2,972,536, 2,972,537, 2,972,538, 3,033,679, 3,072,484, 3,262,807, 3,525,621, 3,615,531, 3,630,743, 3,653,906, 3,655,384 and 3,655,386, British Pat. Nos. 1,222,154 and 1,235,075, hydrophobic polymers as described in, for example, U.S. Pat. Nos. 2,973,263 and 2,976,148, biguanide derivatives set forth in, for example, U.S. Pat. Nos. 2,584,362 and 2,591,590, anionic compounds containing sulfonic acid groups as described in, for example, U.S. Pat. Nos. 2,639,234, 2,649,372, 3,201,251 and 3,457,076, phosphoric acid esters together with quaternary ammonium salts as described in U.S. Pat. Nos. 3,317,344 and 3,514,291, cationic compounds as set forth in, for example, U.S. Pat. Nos. 2,882,157, 2,982,651, 3,399,995, 3,549,369 and 3,564,043, nonionic compounds as disclosed in, for example, U.S. Pat. No. 3,625,695, etc., amphoteric compounds as described in, for example, U.S. Pat. No. 3,736,268, etc., complex compounds as set forth in, for example, U.S. Pat. No. 2,647,836, and organic salts as described in, for example, U.S. Pat. Nos. 2,717,834 and 3,655,387, etc.

The present invention is applicable to every type of monochromatic or color photographic light-sensitive material.

Suitable silver halide emulsions which can be used include orthochromatically and panchromatically sensitized emulsions, infrared recording emulsions, X-ray and other invisible radiation recording emulsions, emulsions for color photography such as, for example, emulsions containing color-forming couplers, dye developers or bleachable dyes, etc.

Where a dye image is to be recorded in a color photographic material, appropriate developing processes are required after image exposure. Color development processing comprises principally color development, bleach and fix procedures. Although these procedures are generally carried out as separate steps, two or more of these procedures may be combined into a single operation by use of a processing solution capable of performing these multiple functions. A typical example is a mono-bath bleach-fix operation. In addition, each procedure can be divided into two or more steps, or other modifications, such as a combination of color development, first fixing and blix, are possible. If necessary, additional procedures can be carried out such as prehardening, neutralization, first development (monochromatic), image stabilization, washing, etc. The processing temperature is appropriately chosen, depending on the photographic recording material and processing formulations involved. A suitable processing temperature is quite often above 18° C., although temperatures lower than 18° C. are sometimes employed. The most useful range is from about 20° to about 60° C., and more preferably from 30° to 60° C., particularly recently. The procedures in processing do not need to be carried out at the same temperature.

A color developer is an aqueous alkaline solution with a pH of about 9 to 12 containing a developing agent which produces on development an oxidized product capable of reacting with a coupler to form a colored product. Examples of color developing agents are those in which a primary amino group is attached to an aromatic nucleus and which can reduce light-exposed silver halide, or a precursor of such a compound. Suitable specific examples of developing agents include, for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfoamidoethylaniline, 4-amino-N,N-dimethylaniline, 4-amino-3-methoxy-N,N-diethylaniline, 4-amino-3-methyl-N-ethyl-N-β-methoxyethylaniline, 4-amino-3-methoxy-N-ethyl-N-β-methoxyethylaniline, 4-amino-3-β-methanesulfoamidoethyl-N,N-diethylaniline and salts of these compounds (e.g., sulfates, hydrochlorides, sulfites, p-toluene sulfonates, etc.). Further, descriptions of color developing agents are given in U.S. Pat. Nos. 2,193,105 and 2,592,364, Japanese Patent Application (OPI) 64,933/1973, L. F. A. Mason, *Photographic Processing Chemistry*, pp. 226–229, Focal Press, London (1966), etc. Each of the above-described compounds can be used together with a 3-pyrazolidone derivative. Various additives are incorporated in the color developer depending on the requirements involved.

Suitable color developer additives include alkaline agents (e.g., the hydroxides, carbonates or phosphates of alkali metals and ammonia), pH controlling agents or buffers (e.g., weak acids or weak bases such as acetic acid or boric acid, the salts thereof, etc.), development accelerating agents (e.g., pyridinium derivatives described in, for example, U.S. Pat. Nos. 2,648,604 and 3,671,247, cationic compounds, potassium and sodium nitrate, poly(ethylene glycol) condensates and derivatives therof as disclosed in U.S. Pat. Nos. 2,533,990, 2,577,127 and 2,950,970, poly(thioether) compounds as described in British Pat. Nos. 1,020,033 and 1,020,032, and other nonionic compounds, polymeric products having a sulfite ester group as set forth in U.S. Pat. No. 3,068,097, organic amines such as pyridine and ethanolamine, benzyl alcohol, hydrazine, etc.), anti-foggants (e.g., alkali metal bromides and iodides, nitrobenzimidazole derivatives as set forth in U.S. Pat. Nos. 2,496,940 and 2,656,271, mercaptobenzimidazole, 5-methylbenzothiazole, 1-phenyl-5-mercaptotetrazole, etc., compounds for rapid processing as disclosed in U.S. Pat. Nos. 3,113,864, 3,342,596, 3,295,976, 3,615,522 and 3,597,199, thiosulfonyl compounds as set forth in British Pat. No. 972,211, phenazine-N-oxides as set forth in Japanese Patent Publication No. 41,675/1971, anti-foggants as described in *Kagaku Shashin Binran*, Vol. 2, pp. 29–47, etc.), strain- or sludge-preventing agents as described in U.S. Pat. Nos. 3,161,513 and 3,161,514, British Pat. Nos. 1,030,442, 1,144,481 and 1,251,558, agents for enhancing inter- or intra-image effects described in U.S. Pat. No. 3,536,487, etc., preservatives (e.g., sulfites, bisulfites, hydroxylamine hydrochlorides, form-sulfites, alkanolamine-sulfite adducts, etc.), etc.

Usually, color photographic materials are bleached after color development. The bleaching operation may be carried out as a separate step or simultaneously with fixing.

A bleach-fix bath is addition of a fixing agent to a bleaching bath. Suitable bleaching agents include ferricyanide salts, bichromate salts, water-soluble cobalt (III) salts, water-soluble cupric salts, water-soluble quinones, nitrosophenols, polyvalent metal salts containing Fe(III), cobalt(III), Cu(II), etc., complex salts formed between these polyvalent metal cations and organic acids such as, for example, metal complexes of ethylenediamine tetraacetic acid, nitrilotriacetic acid, imino-diacetic acid, N-hydroxy-ethylethylenediamine triacetic acid, and other aminopolycarboxylic acids, malonic acid, tartaric acid, malic acid, diglycolic acid, dithioglycilic acid, 6-dipicolic acid/Cu complex, etc., peracids such as, for example, alkyl peracids, persulfates, permanganates, hydrogen peroxide, etc., hypochlorites, chlorine, bromine, bleaching powder, etc. One or more of these bleaching agents can be used separately or in combination.

Various additives including bleach accelerating agents as disclosed in U.S. Pat. Nos. 3,042,520 and 3,241,966, Japanese Patent Publications Nos. 8,506/1970 and 8,836/1970, etc., can be incorporated in such a bleaching bath.

The following examples are given to illustrate the present invention in greater detail. Unless otherwise indicated herein, all parts, percents, ratios and the like are by weight.

EXAMPLE 1

To 2.0 kg of an aqueous solution containing 12% by weight gelatin together with 7.5 g of sodium dodecylbenzenesulfonate, 90 ml of tricresyl phosphate, 90 ml of ethyl acetate and 3 g of Compound (I-4) dissolved in 30 ml of methyl alcohol were emulsified using a high-speed rotary mixer to prepare Emulsified Dispersion (A). For the purpose of comparison, Emulsified Dispersion (B) was prepared as control in the same way except Compound (I-4) was not used. After storage at 40° C. for up to 50 hours, the particle sizes of the two Emulsified Dispersions (A) and (B) were measured. The results obtained are shown in Table 1 below.

Table 1

| Storage Time after Dissolution (40° C.) | Average Particle Diameter (μ) | | | |
|---|---|---|---|---|
| | 0 | 5 Hrs | 25 Hrs | 50 Hrs |
| Emulsified Dispersion (A) | 0.20 | 0.25 | 0.25 | 0.30 |
| Emulsified Dispersion (B) | 0.40 | 0.55 | 0.75 | 0.83 |

The results in Table 1 reveal that the average particle size of the oily phase in Emulsified Dispersion (A) is smaller than that in the control, Emulsified Dispersion (B), with a suppressed rate of growth during storage after the gelatin-containing aqueous phase had been dissolved.

EXAMPLE 2

Into a solvent mixture of 40 ml of dibutyl phthalate and 80 ml of ethyl acetate, 80 g of 2-(2'-hydroxy-3'-methyl-5'-sec-butylphenyl)benzotriazole was dissolved. The resultant solution was emulsified in 2.0 kg of a 10% by weight aqueous gelatin solution which contained 5 g of sodium dodecylbenzenesulfonate using the same method as employed in Example 1. The dispersion, Emulsified Dispersion (C), thus-prepared was a control. Four Emulsified Dispersions (D), (E), (F) and (G) were prepared by adding Compound (I-2), Compound (I-4), Compound (I-8) and Compound (II-2), respectively, to the oily phase of control Emulsified Dispersion (C).

All the dispersions were cooled to set and kept at 6° C. for one week whereby crystal separation took place in Emulsified Dispersion (C) and no change was observed for the other dispersions.

EXAMPLE 3

Control Photographic Film I was prepared by coating the following layers on a cellulose triacetate substrate in this order.

Layer 1. (red-sensitive silver halide emulsion layer)

To 100 g of a silver halide emulsion containing 10 g of gelatin and 0.06 mol of silver iodobromide (AgI content: 7 mol%), $1.8\times10^{-5}$ mol of the following spectral sensitizer:

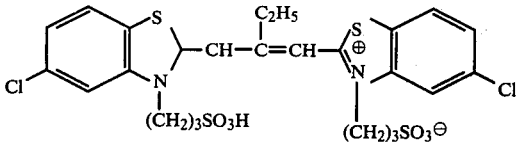

was added, and further the following Emulsified Dispersion (H) was added in such a rate that the coupler amount was $1\times10^{-1}$ mol per mol of AgX. The mixture thus-prepared was coated in a coated silver amount of 2 g/m$^2$.

Layer 2. (gelatin intermediate layer)

The coating amount of gelatin was 1 g/m$^2$.

Layer 3. (green-sensitive silver halide emulsion layer)

To 100 g of a silver halide emulsion containing 10 g of gelatin and 0.06 mol of silver iodobromide (AgI content: 6 mol%), $3\times10^{-5}$ mol of the following spectral sensitizer:

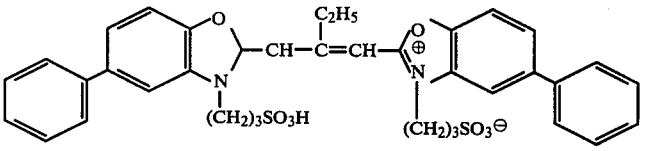

was added, and further the following Emulsified Dispersion (I) was added in such a rate that the coupler amount was $1\times10^{-1}$ mol per mol of AgX. The mixture thus-prepared was coated in a silver coating amount of 2 g/m$^2$.

Layer 4. (yellow filter layer)

A layer of 0.8 g/m$^2$ of gelatin and 0.5 g/m$^2$ of yellow colloidal silver.

Layer 5. (blue-sensitive silver halide emulsion layer)

The following Emulsified Dispersion (J) was added to 100 g of a silver halide emulsion containing 10 g of gelatin and 0.06 mol of silver iodobromide (AgI content: 6 mol%) in such a rate that the coupler amount was $2\times10^{-1}$ mol per mol of AgX. The mixture thus-prepared was coated in a silver coating amount of 1.2 g/m$^2$.

Layer 6. (protective gelatin layer)

The coating amount of gelatin was 0.8 g/m$^2$.

Table 2

| Composition of Emulsified Dispersion | Emulsified Dispersion | | |
|---|---|---|---|
| | H | I | J |
| Gelatin (10 wt% aq. soln.) | 100 g | 100 g | 100 g |
| Sodium Dodecylbenzene-sulfonate | 0.5 g | 0.5 g | 0.5 g |
| Dibutyl Phthalate | 10 ml | 10 ml | 10 ml |
| Ethyl Acetate | 5 ml | 5 ml | 5 ml |

Table 2-continued

| Composition of Emulsified Dispersion | Emulsified Dispersion | | |
|---|---|---|---|
| | H | I | J |
| Coupler | C-1* 10 g | M-1** 10 g | Y-1*** 10 g |

*Coupler C-1

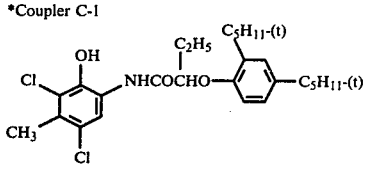

**Coupler M-1

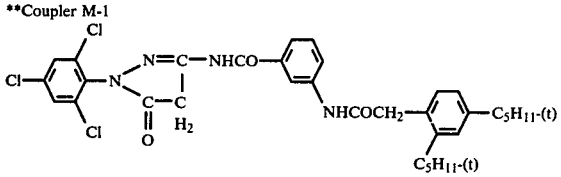

***Coupler Y-1

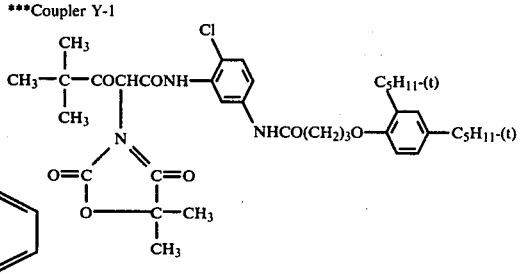

The sodium salt of 2-hydroxy-4,6-dichloro-s-triazine was used as a gelatin hardener in an amount of 1% by weight of the dry weight of the gelatin present. Sample Photographic Film II was prepared by exactly repeating the preparation steps for Control Photographic Film I except that, in place of Emulsified Dispersions H, I and J, Emulsified Dispersions K, L and M were used. The difference between Emulsified Dispersion K from H, L from I and M from J was that the first recited emulsified dispersion contained 0.2 g of Compound (I-4) as an organic solvent gelling agent. The particle size of all of the emulsified dispersions were measured after storage at 40° C. for 24 hours. The results of particle size measurement are shown in Table 3 below.

Table 3

| | Emulsified Dispersion | | | | | |
|---|---|---|---|---|---|---|
| | H | K | I | L | J | M |
| Coupler | C-1 | C-1 | M-1 | M-1 | Y-1 | Y-1 |
| Organic Solvent Gelling Agent (I-4) | — | Yes | — | Yes | — | Yes |
| Average Particle Size (in micron) | | | | | | |
| Storage Time after Dissolution: 0 hr | 0.15 | 0.1 | 0.20 | 0.15 | 0.20 | 0.15 |
| Storage Time after Dissolution: 24 hrs | 0.25 | 0.12 | 0.40 | 0.15 | 0.30 | 0.20 |

Photographic Films I and II were processed under the processing conditions specified below without exposure.

| Processing Step | Temperature | Time |
|---|---|---|
| First Development | 30° C. | 3 min |
| Washing | " | 0.5 min |
| Reversal Exposure (uniform exposure of 8,000 luxes for 1 sec) | | |
| Second Development | 30° C. | 4 min |
| Washing | " | 1 min |
| Bleach | " | 1 min |
| Washing | " | 0.5 min |
| Fixing | " | 1 min |
| Washing | " | 1 min |

The processing solutions used had the following composition.

| | |
|---|---|
| First Developer | |
| 4-(N-Methylamino)phenol Sulfate | 2 g |
| Sodium Sulfite | 90 g |
| Hydroquinone | 8 g |
| Sodium Carbonate (monohydrate) | 52.5 g |
| Potassium Bromide | 5 g |
| Potassium Thiocyanate | 1 g |
| Water to make | 1 l |
| Second Developer | |
| Benzyl Alcohol | 5 ml |
| Sodium Sulfite | 5 g |
| Hydroxylamine Hydrochloride | 2 g |
| 4-Amino-3-methyl-N-ethyl-N-(β-methanesulfonamidoethyl)aniline Sesquisulfate (monohydrate) | 1.5 g |
| Potassium Bromide | 1 g |
| Trisodium Phosphate 30 g | |
| Sodium Hydroxide | 0.5 g |
| Ethylenediamine (70% aq. soln.) | 7 ml |
| Water to make | 1 l |
| Bleaching Bath | |
| Potassium Ferricyanide | 100 g |
| Sodium Carbonate | 40 g |
| Glacial Acetic Acid | 20 ml |
| Potassium Bromide | 30 g |
| Water to make | 1 l |
| Fixing solution | |
| Sodium Thiosulfate | 150 g |
| Sodium Acetate | 70 g |
| Sodium Sulfite | 10 g |
| Potassium Alum | 20 g |
| Water to make | 1 l |

The anti-blocking property and scratch resistance of these two Photographic Films I and II were investigated prior to and after processing. The results obtained are shown in Table 4 below. The anti-blocking test was made on square pieces of a size of 4 cm×4 cm. First, these pieces were maintained in an atmosphere with a constant temperature and humidity for 2 days with care to avoid superimposition of the pieces. Then, a load of 50 g/cm$^2$ was placed on the superimposed pieces so that the top layer and the back surface was in contact for one day under a controlled temperature and humidity. Finally, the pieces were separated to measure the blocked area. The numerical values in Table 4 below indicate the percentages of the blocked area to the entire concact area.

The scratch resistance was evaluated by measuring the maximum value of the weight applied to a stainless stylus with a tip diameter of 100 microns before the coating surface of the film was damaged.

Table 4

| | | Photographic Film | |
|---|---|---|---|
| | | Film I | Film II |
| Anti-Blocking Property | | | |
| Prior to Processing | 25° C., 90% RH | 40% | 10% |
| After Processing | 30° C., 90% RH | 70% | 30% |
| Scratch Resistance | | | |
| Prior to Processing | | 30 g | 40 g |
| After Processing | | 20 g | 25 g |

The results in Table 3 indicate improved stabilities of Emulsified Dispersions K, L and M prepared in accordance with the present invention as well as finer particle sizes.

The results in Table 4 show that Photographic Film II prepared according to the present invention has a better performance in anti-blocking and scratch resistance compared with the comparative Photographic Film I.

EXAMPLE 4

The concentration of gelatin in the emulsified dispersion described in Example 1 was changed to 0, 4.4, 8.4, 10 and 12% by weight, to prepare Emulsified Dispersions M, N, O, P, Q, R, S, T, U and V, respectively. The average particle diameter was measured and the sizes listed in Table 5 below were obtained.

Table 5

| | Gelatin Concentration (% by weight) | | | | | | | | | |
|---|---|---|---|---|---|---|---|---|---|---|
| Emulsified | 0 | | 4.4 | | 8.4 | | 10.0 | | 12.0 | |
| Dispersion | M | R | N | S | O | T | P | U | Q | V |
| Gelling Agent(I-4) | Yes | — | Yes | — | Yes | — | Yes | — | Yes | — |
| Average Particle Diameter (micron) | 0.30 | 1.6 | 0.30 | 1.10 | 0.25 | 0.75 | 0.2 | 0.5 | 0.2 | 0.4 |

From the results in Table 5 above, it is evident that, at any level of gelatin concentration or without any gelatin, all of the emulsified dispersions containing the organic solvent gelling agent of the present invention contained a finer emulsion than the corresponding counterpart as well as had an improved dispersion stability.

EXAMPLE 5

On a substrate of a polyethylene laminated paper, a coating mixture containing a silver chlorobromide emulsion (bromide content: 50 mol%) and one of Emulsified Dispersions V, W, X and Y having the following compositions was coated. Further, an aqueous gelatin solution was overcoated in a dry thickness of 1.5 microns. The four sample films were designated Photographic Films III, IV, V and VI.

Table 6

| | Emulsified Dispersion | | | |
|---|---|---|---|---|
| | V | W | X | Y |
| Gelatin (10 wt% aq. soln.) | 100 g | 100 g | 100 g | 100 g |
| Sodium Dodecylbenzene- | | | | |

Table 6-continued

| | Emulsified Dispersion | | | |
|---|---|---|---|---|
| | V | W | X | Y |
| sulfonate | 0.5 g | 0.5 g | 0.5 g | 0.5 g |
| Dibutyl Phthalate | 10 ml | 30 ml | 10 ml | 30 ml |
| Ethyl Acetate | 5 ml | 5 ml | 5 ml | 5 ml |
| Coupler (C-1) | 10 g | 10 g | 10 g | 10 g |
| Organic Solvent Gelling Agent (I-7) | — | — | 0.5 g | 0.5 g |

The coating weights of the essential components such as silver, coupler and gelatin in these photographic films are shown in Table 7 below, together with the weight ratio of dibutyl phthalate (DBP) to gelatin.

Table 7

| | Photographic Film | | | |
|---|---|---|---|---|
| | III | IV | V | VI |
| Emulsified Dispersion | V | W | X | Y |
| Coating Weight of Ag ($g/m^2$) | 0.6 | 0.6 | 0.6 | 0.6 |
| Coating Weight of Coupler ($g/m^2$) | 0.6 | 0.6 | 0.6 | 0.6 |
| Coating Weight of Gelatin ($g/m^2$) | 2.0 | 3.0 | 2.0 | 3.0 |
| Weight Ratio of DBP to Gelatin | 0.3 | 0.6 | 0.3 | 0.6 |

Each of Photographic Films III, IV, V and VI was exposed to light from an incandescent lamp through a continuous optical wedge and subjected to the following processing.

| Process Step | Temperature | Time |
|---|---|---|
| Color Development | 31° C. | 3 min |
| Blix | " | 1 min |
| Washing | " | 2 min |
| Stabilization | " | 1 min |

The processing solutions used had the following composition.

| | |
|---|---|
| **Color Developer** | |
| N-Ethyl-N-β-methanesulfonamidoethyl-3-methyl-4-aminoaniline Sulfate | 4.0 g |
| Hydroxylamine | 2.0 g |
| Potassium Carbonate | 25 g |
| Sodium Chloride | 0.1 g |
| Sodium Bromide | 0.2 g |
| Sodium Sulfite (anhydrous) | 2.0 g |
| Benzyl Alcohol | 10 ml |
| Poly(ethylene glycol) (average degree of polymerizaton: 400) | 3.0 ml |
| Water to make | 1 l (pH: 10.0) |
| **Blix Bath** | |
| Iron-Sodium Ethylenediamine Tetraacetate | 45 g |
| Ammonium Thiosulfate (60% aq. soln.) | 100 g |
| Sodium Bisulfite | 10 g |
| Sodium Metabisulfite | 3 g |
| Water to make | 1 l (pH: 6.6) |
| **Stabilizing Bath** | |
| Tartaric Acid | 10 g |
| Zinc Sulfate | 10 g |
| Sodium Metaborate | 20 g |
| Formaldehyde (37% aq. soln.) | 10 ml |
| Water to make | 1 l (pH: 4.0) |

Each of the processed film pieces was kept at 60° C., 70% RH for 14 days, and then the residual rate of cyan dye was measured at the area where the initial optical density was 1.0. Separately, each film was subjected to the scratch resistance testing described in Example 3. The results obtained are shown in Table 8 below.

Table 8

| | Photographic Film | | | |
|---|---|---|---|---|
| | III | IV | V | VI |
| Scratch Resistance | | | | |
| Prior to Processing | 18 g | 8 g | 18 g | 14 g |
| After Processing | 18 g | 10 g | 20 g | 16 g |
| Remaining Ratio of Cyan dye (%) | 58 | 85 | 60 | 88 |

The results in Table 8 show that the films prepared according to the present invention exhibit a suppressed deterioration of film strength at a high oil content in the emulsion, and an improved fade-resistance for the developed dye.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material comprising a support having thereon at least one silver halide photographic emulsion layer and containing an emulsified dispersion comprising an organic solvent emulsified, as a discontinuous phase, in at least one layer of a hydrophilic colloid as a continuous phase and an organic solvent gelling agent present in said organic solvent and/or in said at least one hydrophilic colloid layer.

2. The photographic light-sensitive material of claim 1, wherein said organic solvent gelling agent is present in said discontinuous phase.

3. The photographic light-sensitive material of claim 1, wherein said organic solvent gelling agent is present in said continuous phase.

4. The photographic light-sensitive material of claim 3, wherein said hydrophilic colloid is gelatin and said gelatin is present in said continuous phase.

5. The photographic light-sensitive material of claims 1, 2, 3 or 4, wherein said organic solvent gelling agent is (1) an N-acylamino acid derivative selected from the group consisting of an N-acylamino acid ester, an N-acylamino acid amide, an N-acylamino acid amine salt, an N-acylamino acid alkali metal salt and an N-acylamino acid ammonium salt, or (2) a condensate of benzaldehyde or a nucleus-substituted derivative thereof and a polyhydric alcohol selected from the group consisting of xylitol and sorbitol.

6. The photographic light-sensitive material of claims 2, 3 or 4, wherein said material additionally contains, as an oleophilic photographic additive, at least one of a coupler, a UV absorbing agent, an antioxidant, a color fading-prevent agent, an oil soluble dye, a development inhibiting releasing compound, a developing agent, a dye developing agent, a dye releasing redox compound and a dye developer releasing coupler.

7. The photographic light-sensitive material of claim 6, wherein said oleophilic photographic additive is a liquid and is emulsified as said discontinuous phase.

8. The photographic light-sensitive material of claim 6, wherein said oleophilic photographic additive is dissolved in an organic solvent and the solution is emulsified as said discontinuous phase.

9. A process for improving physical properties of a photographic light-sensitive material comprising a support having thereon at least one silver halide photographic emulsion layer with the photographic light-sensitive material containing an emulsified dispersion comprising an organic solvent emulsified, as a discontinuous phase, in at least one layer of a hydrophilic colloid as a continuous phase, which process comprises incorporating an organic solvent gelling agent in said organic solvent and/or in said at least one hydrophilic colloid.

* * * * *